US009073800B1

(12) United States Patent
Stepanov et al.

(10) Patent No.: US 9,073,800 B1
(45) Date of Patent: Jul. 7, 2015

(54) INSENSITIVE HIGH ENERGY CRYSTALINE EXPLOSIVES

(71) Applicants: Victor Stepanov, Highland Park, NJ (US); Anthony DiStasio, New York, NY (US); Hongwei Qiu, Harrison, NJ (US); Woo Lee, Ridgewood, NJ (US)

(72) Inventors: Victor Stepanov, Highland Park, NJ (US); Anthony DiStasio, New York, NY (US); Hongwei Qiu, Harrison, NJ (US); Woo Lee, Ridgewood, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 13/751,515

(22) Filed: Jan. 28, 2013

Related U.S. Application Data

(63) Continuation-in-part of application No. 12/565,990, filed on Sep. 24, 2009, now abandoned.

(51) Int. Cl.

| | |
|---|---|
| ***C06B 45/00*** | (2006.01) |
| ***C06B 45/12*** | (2006.01) |
| ***C06B 25/34*** | (2006.01) |
| ***D03D 23/00*** | (2006.01) |
| ***D03D 43/00*** | (2006.01) |
| ***C06B 45/22*** | (2006.01) |

(52) U.S. Cl.
CPC ..... *C06B 45/22* (2013.01)

(58) Field of Classification Search
USPC ..... 149/11, 2, 3, 88, 92, 109.4
See application file for complete search history.

(56) References Cited

U.S. PATENT DOCUMENTS

| | | | | |
|---|---|---|---|---|
| 6,214,988 | B1 * | 4/2001 | Lukasavage et al. | 540/475 |
| 6,893,518 | B1 * | 5/2005 | Simpson et al. | 149/109.6 |
| 2003/0094224 | A1 * | 5/2003 | Lee et al. | 149/19.7 |
| 2006/0272755 | A1 * | 12/2006 | Borne | 149/21 |

OTHER PUBLICATIONS

Yongxu et al. Preparation and Characterization of Reticular Nano-HMX, propellants, explsoives pyrotechnics 30, No. 6 (2005).*

* cited by examiner

*Primary Examiner* — James McDonough
(74) *Attorney, Agent, or Firm* — Henry S. Goldfine

(57) ABSTRACT

An insensitive crystalline high explosive molding powder, usable as a booster HE. The subject insensitive crystalline high explosive molding powder being manufactured by adding the crystalline high explosive, and a polymer or wax based binder to a solvent to form a solution, spray drying the solution to drive off the solvent, thereby co-precipitating the HE and binder to form granules in which the crystals of HE are uniformly distributed in the binder.

4 Claims, No Drawings

INSENSITIVE HIGH ENERGY CRYSTALINE EXPLOSIVES

CROSS REFERENCE TO RELATED APPLICATION

This application is a continuation-in-part of copending U.S. patent application Ser. No. 12/565,990, filed Sep. 24, 2009, which application is incorporated herein by reference, as if set forth in its complete length.

FEDERAL RESEARCH STATEMENT

The invention described herein may be manufactured, used, and licensed by or for the U.S. Government for U.S. Government purposes.

BACKGROUND OF INVENTION

1. Field of the Invention

The present invention relates to insensitive crystalline high explosive molding powders, and more particularly to such insensitive explosive molding powders where the crystallizations are coated with non-energetic binders.

2. Related Art

Sensitivity of munitions to undesired stimuli, such as shock and impact, increases the potential of accidental initiation, which can result in loss of life, as well as, significant cost and compromised capabilities. Minimizing such sensitivity is therefore highly desired.

A particularly critical application which involves balancing insensitivity and explosive effectiveness involves booster explosives, which must have a sufficient energy output to reliably initiate newer, relatively insensitive main charge explosive fills, while having themselves a lower level of sensitivity to unintended stimuli. Most existing booster high explosive (HE) formulations exhibit unacceptable levels of sensitivity thereby increasing the vulnerability of the entire munition to accidental initiation.

It is well known that the crystal size of a HE can significantly influence its sensitivity to unintended stimuli such as shock and impact; specifically, it has been demonstrated that the sensitivity of a high explosive decreases with decreasing crystal size. See, Stepanov et al. "Processing and Characterization of Nanocrystalline RDX", Proceedings of the 39th International Annual Conference of ICT, 2008 Karlsruhe, Germany. Further, improved performance characteristics are also associated with crystal size reduction. For example, the detonation failure diameter, also referred to as the critical diameter, is known to decrease with decreasing crystal size.

There are two relatively complex methods known to produce basically pure, nanocrystalline HE, including 1,3,5-trinitro-1,3,5-triazacyclohexane, also known as RDX. The first method produces RDX with a mean crystal size in the range from around 100 to 500 nm is disclosed in Stepanov et al, "Production of Nanocrystalline RDX by Rapid Expansion of Supercritical Solutions", *Propellants, Explosives, Pyrotechnics* Vol. 30, No. 3, pages 178-183 (Wiley-VCH Verlag, GmbH & Co., KGaA, Weinheim, 2005). The second method which uses a bead mill to produce RDX with a mean crystal size below 500 nm is disclosed in R. Patel et al., "Slurry Coating Process for Nano-RDX produced by a Bead Mill", NDIA Insensitive Munitions and Energetic Materials Technology Symposium, 2008, Miami, Fla.

An alternative method that produces a broad range of pure RDX crystals from 400 nanometer particles to several micron particles, involves the evaporative crystallization of RDX by spray drying an RDX/acetone solution. See, Van der Heijden et al., "Energetic Materials: Crystallization, Characterization, and Insensitive Plastic Bonded Explosives, Propellants, Explosives, Pyrotechnics, Vol. 33, No. 1, pages 25-32 (Wiley-VCH Verlag, GmbH & Co., KGaA, Weinheim, 2008).

U.S. Pat. No. 6,485,587, issued Nov. 26, 2002 to Han et al., incorporated herein by reference, discloses traditional methods used for the preparation of explosive molding powders typically consist of batch slurry coating of crystalline HE with a binder. In these processes, the explosive crystals are dispersed in an aqueous slurry, to which a lacquer solution consisting of an organic solvent and the binder ingredients are added. Dispersion of nano-crystals in an aqueous slurry is not effective due to the high tendency of the such small crystals to agglomerate, resulting in poor coating of the crystals.

Handling of uncoated HE nanoparticles, such as occurs in the production of the nanocrystalline HE, and the subsequent processing, poses a health hazard. Such small particles are easily airborne and absorbed into the body.

There is a need in the art for a relatively insensitive HE, with good performance characteristics, that is manufactured in a safe, relatively simple and economical way.

SUMMARY OF INVENTION

The present invention relates to a novel, insensitive high explosive molding powder with a surprisingly small crystal size and high uniformity of binder distribution, achieved with a simple and economical means of production. The explosive molding powder of this invention is manufactured by co-precipitating the crystalline HE and the required binder from a solution, which may be organic, aqueous, or a combination aqueous/nonaquous, using commercially available spray drying technology. Using this process, HE crystal particles from about 50 nanometers to about 2 microns have been obtained, and surprisingly the mean HE crystal size is below 500 nanometers and all of which particles are uniformly coated with binder. The size of the recovered molding powder dried granules, the final product, containing the coated crystalline HE particles, ranges from about 0.5 microns to about 50 microns in size, preferably from about 1 micron to about 20 microns. The composition of such molding powder granules can be readily controlled with typical composition ranging from 50 to 99 wt. % HE and the balance being binder and/or binder and any desired additives, such as a plasticizer or surfactant.

This novel high explosive molding powder overcomes the problems of the prior art by exhibiting a significant reduction in shock and impact sensitivity, while also exhibiting improved detonation characteristics such as a lowered critical diameter, enabling application of this insensitive material in explosive charges with small dimensions, such as boosters. Further, this invention overcomes the problems of the prior art related to preparation of nanocrystal line HE based molding powders by consolidating the crystal formation and coating into a one-step, safe, and economical process.

The method described in the present invention is suitable for a variety of known HE compounds, including RDX, HMX, CL-20, and others, or combinations thereof. The binder must be a non-energetic material, preferably polymer or wax based with a wide range of molecular weights, and may contain plasticizers, surfactants and other minor ingredients as desired.

The method described in the present invention is also suitable for the preparation of melt-castable compositions with appropriate selection of polymer or wax for the binder phase. In such instance granules produced by the novel spray drying method would be molten and loaded into the munition in the molten state rather than being pressed when used as a molding powder.

DETAILED DESCRIPTION

The insensitive high explosive molding powder of the present invention is formed of granules, containing from about 50 to 99 weight percent of a crystalline high explosive material, and the balance of the weight percentage being a non-energetic binder; wherein the crystals within the high energy explosive material are uniformly coated with the non-energetic binder, and wherein the mean crystal size is below 500 nanometers, and wherein the granules range from about 0.5 to about 50 microns in size. HE molding powders of the present invention are manufactured by dissolving the crystalline HE and the binder ingredients, including any desired plasticizer or surfactant, in the chosen solvent. The relative amounts of the various ingredients dissolved should be chosen to reflect the desired composition of the molding powder, as the composition of the resulting molding powder granules will be nearly-identical to the relative composition of such ingredients initially placed solution. Preferably the inventive formulation consists of 50 to 99 weight percent crystalline HE and the balance being the binder ingredients.

Commercially available spray dryers may be readily used in this invention. Depending on the desired grain size of the molding powder several spraying approaches can be selected. The atomization of the feed solution may be achieved using a variety of standard atomizers including compressed gas, ultrasonic nozzle, and rotary disk. The droplet size distribution may be varied by manipulation of the solution feed rate, and by nozzle settings. For example, the commonly used gas atomized nozzle, the nozzle diameter and the atomizing gas flow rate may be adjusted to get the desired droplet size—to result in a particular granule size. In the case of the ultrasonic nozzle the nozzle frequency may be used as the control parameter.

The selection of the solvent used in the present invention is flexible, and is based on the solubility of the ingredients to be processed as well as parameters, such as boiling point and viscosity, which can impact the characteristics of atomization and drying during spray drying. For such crystalline HE ingredients as RDX, HMX and CL-20, the solvent must be organic and can preferably be acetone, which easily dissolves such crystalline explosives and which exhibits a relatively low boiling point. However, if necessary other solvents may be chosen that exhibit suitable solvent strength for the desired molding powder ingredients.

In the present invention, as is common in spray drying, the precipitation of the dissolved ingredients and formation of granules is achieved by atomizing the solution into droplets and drying such droplets in a flowing stream of heated gas. When the subject invention contains an organic solvent air may not be used as the drying gas, as the mixture of the oxygen within the air, and the solvent vapor is combustible. Therefore, an inert gas, such as $N_2$, is preferred, whenever an organic solvent is used. Processing cost can be greatly reduced when manufacturing utilizing inert gases by incorporate a gas recycling loop, where the majority of the organic vapor is removed, and the drying gas is recycled. Such an approach enables the recovery of the majority of the solvent used, which can also be recycled.\

In the subject inventive spray drying process the precursor solution may be fed to the atomizer using a variety of available liquid pumps, however, for product uniformity, it is desired that the pumping be relatively steady, rather than pulsating. Possible pumps include but are not limited to: centrifugal, peristaltic, piston, and diaphragm type pumps.

Furthermore, in the subject spray drying process, the temperature of the drying chamber should be selected such that the solution droplets are completely or nearly completely dried within the drying chamber. The temperature should not exceed that at which decomposition of the product may occur. Typically, a temperature near the boiling point temperature of the particular solvent is preferred.

Finally, the molding powder granules obtained from the subject inventive spray drying process are separated and recovered from the gas stream using a cyclone separator, filtration, or other known means.

Example 1

An explosive molding powder containing 83 wt. % RDX and 17 wt. % vinyl resin, UCAR™ VMCC Solution Vinyl Resin (Dow), binder was prepared. The VMCC resin hinder is a carboxy-functional terpolymer consisting of vinyl chloride (83%), vinyl acetate (16%), and maleic acid (1%). The VMCC resin binder has a 19,000 MW and 1.34 g/cc density. Both RDX and the resin were dissolved in acetone at room temperature. The acetone solution contained 5 wt. % RDX and 1 wt. % VMCC. The solution was spray dried using a Büchi 190 spray dryer (Büchi Labortechnik AG, Switzerland), equipped with an ultrasonic nozzle from Sono-Tek Inc., Milton, N.Y. The ultrasonic nozzle has an operating frequency of 60 kHz. The solution feed rate was set to 5 ml/min. The nozzle power was set to 1.1 W. The inert drying gas ($N_2$) inlet temperature was set to 55° C. The product was collected using a cyclone separator.

The product granule size ranged from 5 to 15 μm. Optical and electron microscopy revealed that the granules are primarily composed of nanocrystalline RDX. Characterization also revealed that the crystals were uniformly distributed within the polymeric binder, i.e. the crystals were uniformly coated with binder. The composition of the product was verified using HPLC analysis.

Example 2

Using the procedure outlined in Example 1 a molding powder consisting of 83 wt. % RDX and 17 wt. % polyvinyl acetate, PVAc, (Sigma-Aldrich, St. Louis, Mo.) binder was prepared. Compared to the VMCC resin used in Example 1, this PVAc resin has a higher molecular weight, 113,000, and a lower density, 1.19 g/cc. Both RDX and PVAc were dissolved in acetone at room temperature. The acetone solution contained 5 wt. % RDX and 1 wt. % PVAc. Optical and electron microscopy revealed that the granule size, the HE crystal size, and the uniformity of binder coating on the HE crystals was similar to the sample described in Example 1.

Sensitivity Analysis

The initiation sensitivity of the molding powders prepared according to Examples 1 and 2 was determined for shock and impact stimuli. For comparison a sample with a similar composition to the material described in Example 1 was prepared using a conventional slurry coating process, wherein 4 micron RDX (Fluid Energy Milled (FEM) grade from BAE Systems, Rockville, Md.) was used as the HE ingredient. Such 4 micron FEM RDX is one of the smallest particle size, commercially available grades of RDX.

The samples were subjected to impact sensitivity tests performed using an ERL, Type 12 impact tester, with a 2.5 kg drop weight. This method is described in MIL STD 1751 A, Method 1012, "Impact Sensitivity Test-ERL (Explosives Research Laboratory)/Bruceton Apparatus," copies of which are available at http://assist.daps.dla.mil/ or from the Department of Defense, Standardized Document Order Desk, 700 Robbins Avenue, Bldg., 4D, Philadephia, Pa. 19111-5094. The test is performed by dropping the drop weight from incremental heights and recording whether initiation, i.e. an explosion, occurred. The drop height is adjusted in order to determine the height at which initiation probability is 50% ($H_{50}$). The impact sensitivity is given as the $H_{50}$ value. The impact sensitivity test results are shown in Table 1, below—showing, that the subject inventive spray drying method produces an RDX/VMCC composition that is significantly less sensitive to impact than the commercially available 4 micron RDX based molding powder with the same composition produced by a conventional slurry coating process.

TABLE 1

Impact Sensitivity Values

| Material | Impact Sensitivity $H_{50}$ (cm) |
|---|---|
| RDX/VMCC (Slurry Coated) | 69.3 |
| RDX/VMCC (Spray Dried) | 82.5 |
| RDX/PVAc (Spray Dried) | 75.0 |

Shock sensitivity analysis was performed with the NOL Small-Scale Gap Test according to MIL-STD-1751A, Method 1042, copies of which are available at http://assist.daps.dla.mil/ or from the Department of Defense, Standardized Document Order Desk, 700 Robbins Avenue, Bldg., 4D, Philadelphia, Pa. 19111-5094. The three samples were pressed to comparable percentages of theoretical maximum density (% TMD). The shock sensitivity test results are summarized in Table 2.

TABLE 2

Shock Sensitivity Values

| Material | Shock Sensitivity[1] (dBg) | Shock Sensitivity[2] (kbar) | Sample Density (g/cc) | % TMD |
|---|---|---|---|---|
| RDX/VMCC (Slurry Coated) | 6.2 | 24.5 | 1.58 | 95.2 |
| RDX/VMCC (Spray Dried) | 7.1 | 33.1 | 1.56 | 94.0 |
| RDX/PVAc (Spray Dried) | 7.7 | 40.4 | 1.58 | 93.1 |

[1]Small-Scale Gap Test (SSGT) Method - shock sensitivity in decibangs (dBg) units.
[2]Shock sensitivity in kbar units.

The shock sensitivity values of the novel RDX/VMCC and RDX/PVAc, formulations that were spray dried according to the current invention are significantly better than the RDX/VMCC formulation manufactured according to the prior art slurry coating method, in fact the shock pressure (in kbar) to initiate an explosion is about 35% greater than the conventional RDX/VMCC. In summary, such direct comparison of the sensitivity of the inventive spray dried vs. slurry coated samples, shows a marked decrease of the inventive spray dried product's sensitivity to both impact and shock stimuli.

It must be noted, that the much less shock sensitive novel compositions prepared by the novel spray drying method also exhibited a low critical diameter, as evidenced by the detonability of these materials in the 5 mm internal diameter cylinders used in the small-scale gap test.

Although the invention has been described in general terms and using specific examples, it is understood by those of ordinary skill in the art that variations and modifications can be effected to these general and specific embodiments, without departing from the scope and spirit of the invention.

We claim:

1. An insensitive high explosive molding powder comprising:

granules containing from about 50 to 99 weight percent of a crystalline high explosive material;

the balance of the weight percentage of the granules being a non-energetic binder; wherein the crystals within the high energy material are uniformly coated with the non-energetic binder; wherein the mean crystal size is below 500 nanometers; and where the granules range from 0.5 microns to about 50 microns in size.

2. The insensitive high explosive molding powder according to claim 1, where in the crystalline high explosive is selected from the group consisting of RDX, HMX, CL-20, or combination thereof.

3. The insensitive high explosive molding powder according to claim 1, wherein the binder may be a polymer or wax based materials.

4. The insensitive high explosive molding powder according to claim 1, containing a plasticizer or a surfactant.

* * * * *